US009109526B2

(12) United States Patent
Giencke

(10) Patent No.: US 9,109,526 B2
(45) Date of Patent: Aug. 18, 2015

(54) CONTROL UNIT FOR FUEL SUPPLY REGULATION DURING A COLD-RUNNING PHASE OF AN INTERNAL COMBUSTION ENGINE, METHOD FOR FUEL SUPPLY REGULATION DURING A COLD-RUNNING PHASE OF AN INTERNAL COMBUSTION ENGINE, COMPUTER PROGRAM PRODUCT, COMPUTER PROGRAM AND SIGNAL SEQUENCE

(75) Inventor: Martin Giencke, Frankfurt (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 804 days.

(21) Appl. No.: 13/441,403

(22) Filed: Apr. 6, 2012

(65) Prior Publication Data

US 2012/0255533 A1 Oct. 11, 2012

(30) Foreign Application Priority Data

Apr. 9, 2011 (DE) ..... 10 2011 016 639

(51) Int. Cl.
*F02D 41/06* (2006.01)
*F02D 41/14* (2006.01)

(52) U.S. Cl.
CPC ..... *F02D 41/068* (2013.01); *F02D 41/064* (2013.01); *F02D 41/1454* (2013.01); *F02D 41/1482* (2013.01); *F02D 41/1483* (2013.01); *F02D 2041/1409* (2013.01); *F02D 2041/1422* (2013.01)

(58) Field of Classification Search
CPC . F02D 41/064; F02D 41/068; F02D 41/1475; F02D 2041/1409; F02D 2041/142; F02D 2041/1481; F02D 2041/1482
USPC ..... 123/685
See application file for complete search history.

(56) References Cited

U.S. PATENT DOCUMENTS

| | | | | |
|---|---|---|---|---|
| 5,465,697 | A * | 11/1995 | Hamburg et al. | 123/406.47 |
| 5,797,369 | A * | 8/1998 | Suzuki et al. | 123/436 |
| 5,915,359 | A * | 6/1999 | Meyer et al. | 123/436 |
| 6,029,641 | A * | 2/2000 | Suzuki et al. | 123/673 |
| 6,240,724 | B1 | 6/2001 | Kudou et al. | |
| 2009/0173323 | A1 * | 7/2009 | Ishii et al. | 123/685 |

FOREIGN PATENT DOCUMENTS

| | | |
|---|---|---|
| DE | 19728926 C1 | 1/1999 |
| DE | 69916940 T2 | 5/2005 |

OTHER PUBLICATIONS

German Patent Office, German Search Report dated Oct. 11, 2011 for German Application No. 102011016639.4.

* cited by examiner

*Primary Examiner* — Erick Solis
(74) *Attorney, Agent, or Firm* — Ingrassia Fisher & Lorenz PC

(57) ABSTRACT

A control unit is provided for fuel supply regulation during a cold-running phase of an internal combustion engine, that includes, but is not limited to an input port for inputting a combustion signal about the presence of a rich or lean combustion of a fuel mixture in the internal combustion engine, a P-element for providing a P-manipulated variable, which sets a fuel reduction upon the presence of a rich combustion and sets a fuel increase upon the presence of a lean combustion, an I-element for providing an I-manipulated variable, which sets a fuel increase, and an output port for controlling a fuel supply, the P-manipulated variable and the I-manipulated variable substantially offsetting one another during the cold-running phase upon the presence of a rich combustion in the stationary state.

16 Claims, 4 Drawing Sheets

CONTROL UNIT FOR FUEL SUPPLY REGULATION DURING A COLD-RUNNING PHASE OF AN INTERNAL COMBUSTION ENGINE, METHOD FOR FUEL SUPPLY REGULATION DURING A COLD-RUNNING PHASE OF AN INTERNAL COMBUSTION ENGINE, COMPUTER PROGRAM PRODUCT, COMPUTER PROGRAM AND SIGNAL SEQUENCE

CROSS-REFERENCE TO RELATED APPLICATION

This application claims priority to German Patent Application No. 10 2011 016 639.4, filed Apr. 9, 2011, which is incorporated herein by reference in its entirety.

TECHNICAL FIELD

The technical field relates to a control unit for fuel supply regulation during a cold-running phase of an internal combustion engine, a method for fuel supply regulation during a cold-running phase of an internal combustion engine, a computer program product, a computer program, and a signal sequence, with the aid of which the fuel quantity to be supplied to an internal combustion engine is controlled during the cold-running phase.

BACKGROUND

During a cold-running phase of an internal combustion engine, the internal combustion engine is not yet at operating temperature, so that to ensure combustion of a fuel/air mixture in the internal combustion engine, a rich combustion is intentionally provided, i.e., a combustion having a super stoichiometric fuel fraction. If a discrete-level sensor is used as the exhaust gas sensor (e.g., a lambda sensor), which can only detect the presence of a rich combustion or the presence of a lean combustion, i.e., a combustion having sub stoichiometric fuel fraction, the intentionally super stoichiometric fuel supply cannot be regulated via an exhaust gas regulation. Therefore, a lambda regulation of the fuel supply is deactivated during the cold-running phase. There is a need for allowing reliable and efficient fuel supply during the cold-running phase of an internal combustion engine.

In view of the foregoing, it is at least one object to specify measures which allow reliable and efficient fuel supply during the cold-running phase of an internal combustion engine. In addition, other objects, desirable features and characteristics will become apparent from the subsequent summary and detailed description, and the appended claims, taken in conjunction with the accompanying drawings and this background.

SUMMARY

One embodiment relates to a control unit for fuel supply regulation during a cold-running phase of an internal combustion engine, comprising an input port for inputting a combustion signal about the presence of a rich or lean combustion of a fuel mixture in the internal combustion engine, a P-element for providing a P-manipulated variable, which sets a fuel reduction upon the presence of a rich combustion and a fuel increase upon the presence of a lean combustion, an I-element for providing an I-manipulated variable, which sets a fuel increase, and an output port for controlling a fuel supply, the P-manipulated variable and the I-manipulated variable substantially offsetting one another during the cold-running phase upon the presence of a rich combustion in the stationary state. Because the P-manipulated variable and the I-manipulated variable can offset one another during the cold-running phase upon the presence of a rich combustion, the control unit does not generate a significant control signal in the scope of typical regulating and measurement inaccuracies, which would cause a reduction of the fuel supply. However, if a lean combustion is detected during the cold-running phase, via the P-element, the addition of the P-manipulated variable and the I-manipulated variable can result in a particularly high total manipulated variable, which causes a strong increase of the fuel supply, in order to be able to reproduce the intended particularly rich combustion rapidly. This allows, even in the event of a comparatively small extent of the super stoichiometric supply of fuel, states having a lean combustion to be avoided and/or the occurrence and duration thereof to be reduced, without impairing the operating state of a rich combustion. Reliable and efficient fuel supply is thus made possible during the cold-running phase of an internal combustion engine.

After passage of the cold-running phase, an exhaust gas regulation can be activated and the parameters of the P-element and/or the I-element being able to be set to values suitable for the active exhaust gas regulation. The control unit can particularly be connected using its input port and/or using its output port to a motor vehicle data bus, in particular a CAN bus, to be able to exchange data and information. Additionally or alternatively, the input port and/or the output port can preferably be exclusively connected to an engine control unit, to be able to exchange data particularly rapidly.

The P-element has an essentially proportional behavior of the P-manipulated variable to a reference variable at the input of the P-element. The I-element has an essentially integral behavior of the I-manipulated variable to a reference variable at the input of the I-element. In particular a stoichiometric combustion in the internal combustion engine having a lambda value of approximately 1.0 is selected as the reference variable, a lambda value less than approximately 1.0 being intended during the cold-running phase. The combustion signal can be provided by an exhaust gas sensor, which is particularly designed as a discrete-level sensor. If the total manipulated variable of the control unit is designed as a multiplier for a controller of a fuel supply, the P-manipulated variable and the I-manipulated variable offset one another during the cold-running phase upon the presence of a rich combustion in the stationary state, i.e., if no changes of the P-manipulated variable and the I-manipulated variable are performed, to form a value of approximately 1.0 with a permitted error deviation of approximately ±0.10, in particular approximately ±0.05, preferably approximately ±0.02, and particularly preferably approximately ±0.01. If the total manipulated variable of the control unit is designed as a summand for a controller of a fuel supply, the P-manipulated variable and the I-manipulated variable offset one another during the cold-running phase upon the presence of a rich combustion in the stationary state to form a value of approximately 0.0 with a permitted error deviation of approximately ±10.0%, in particular approximately ±5.0%, preferably approximately ±2.0%, and particularly preferably approximately ±1.0% in relation to the further summand provided by the fuel supply. Through the substantial offsetting of the P-manipulated variable by the I-manipulated variable, the remaining difference of the I-manipulated variable and the P-manipulated variable in relation to the mean value of the P-manipulated variable and the I-manipulated variable is particularly at most approximately 0.1%, preferably at most approximately 0.05%, particularly preferably at most approximately 0.02%, and more preferably at most approximately 0.01%.

The absolute value of the I-manipulated variable is particularly preferably greater than the absolute value of the P-manipulated variable, so that a total manipulated variable results, which controls a slight fuel enrichment and, with sufficient reliability, does not activate a leaner combustion.

In particular, the P-manipulated variable results through a P-manipulated absolute value reversible by a P-mean value. The P-manipulated absolute value is in particular of equal size upon the presence of a rich combustion and upon the presence of a lean combustion, the P-manipulated absolute value changing its sign ("reversing") in the event of a change between a detected rich combustion and a detected lean combustion. The P-manipulated absolute value can preferably be increased, after a reverse, from a P-nominal value up to a maximum P-final absolute value. If the current total manipulated variable of the control unit is not sufficient to cause a change between a state having lean combustion and a state having rich combustion in a short time, a correspondingly large total manipulated variable can be provided by the increase of the P-manipulated absolute value. The increase of the P-manipulated absolute value from the P-nominal value up to the maximum P-final absolute value preferably occurs gradually, for example, in an S shape or sinusoidally, in order to avoid instabilities. In particular, the stationary state for the P-manipulated variable is reached after reaching the P-final absolute value.

The absolute value of the I-manipulated variable can particularly preferably be increased, upon the presence of a lean combustion, from an I-manipulated value, the absolute value of the I-manipulated variable in particular being able to be increased incrementally. If the current total manipulated variable of the control unit is not sufficient to cause a change between a state having lean combustion and a state having rich combustion in a short time, a correspondingly large total manipulated variable can be provided by the increase of the I-manipulated variable. Instabilities can be avoided by the incremental increase of the of the I-manipulated variable, in that, for example, the level of the following increment and/or the time duration until the next increment are adapted suitably.

In particular, the absolute value of the I-manipulated variable can be decreased to a defined minimal I-manipulated value upon the presence of a rich combustion, the absolute value of the I-manipulated variable being able to be decreased incrementally in particular. A previously performed increase of the I-manipulated variable can be reversed until reaching the defined minimal I-manipulated value. Through the incremental decrease of the I-manipulated variable, instabilities may be avoided, in that, for example, the level of the following increment and/or the time duration until the next increment are adapted suitably.

A temperature port is preferably provided for inputting a temperature signal for estimating the temperature of the internal combustion engine, in particular the coolant water temperature, the absolute value of the P-manipulated variable and the absolute value of the I-manipulated variable being able to be decreased as a function of the temperature signal. An ending of the cold-running phase can be estimated by the detection of an increasing temperature, in particular the coolant water temperature of the coolant water for the internal combustion engine. This allows the absolute value of the total manipulated variable to be gradually reduced and to be adapted to an absolute value as is used in the case of an activated exhaust gas regulation.

One embodiment relates to an engine controller for the fuel supply regulation during a cold-running phase of an internal combustion engine, comprising a control unit, which can be implemented as refined as described above, an exhaust gas sensor, which is connected to the control unit, in particular a discrete-level sensor, for detecting a rich and/or lean combustion in the internal combustion engine, and a fuel supply, which is connected to the control unit, for controlling a fuel quantity to be supplied to the internal combustion engine. Reliable and efficient fuel supply is thus made possible during the cold-running phase of an internal combustion engine. A temperature measuring sensor, in particular for measuring a temperature of coolant water for cooling the internal combustion engine, is preferably connected to the control unit.

One embodiment relates to a method for fuel supply regulation during a cold-running phase of an internal combustion engine with the aid of a control unit, which can particularly be implemented and refined as described above, the control unit having a P-element for providing a P-manipulated variable, which sets a fuel reduction upon the presence of a rich combustion and sets a fuel increase upon the presence of a lean combustion, and an I-element for providing an I-manipulated variable, which sets a fuel increase, in which the P-manipulated variable and the I-manipulated variable substantially offset one another during the cold-running phase upon the presence of a rich combustion in the stationary state. Reliable and efficient fuel supply is thus made possible during the cold-running phase of an internal combustion engine. After passage of the cold-running phase, an exhaust gas regulation can be activated and the parameters of the P-element and/or the I-element being able to be set to values suitable for the active exhaust gas regulation. The method is particularly implemented and refined as described above on the basis of the control unit.

In particular, the P-manipulated variable and the I-manipulated variable add up upon the presence of a lean combustion to form a total manipulated variable, the maximum absolute value of the total manipulated variable being greater during the cold-running phase than after passage of the cold-running phase. Upon the detection of a lean combustion, a particularly strong increase of the fuel supply can thus be initiated, so that the intentionally fuel-rich operation can be achieved again, in the case of an activated exhaust gas regulation ("lambda regulation"), smaller absolute values of the total manipulated variable being able to be used to be able to keep the combustion in a lambda window of approximately $\lambda=1.0\pm0.03$ in particular.

The absolute value of the P-manipulated variable is preferably increased during the cold-running phase upon the presence of a lean combustion after passage of a P-dead time. If the current total manipulated variable of the control unit is not sufficient to cause a change between a state having lean combustion and a state having rich combustion within the P-dead time, a correspondingly large total manipulated variable can be provided by the increase of the absolute value of the P-manipulated variable. The increase of the absolute value of the P-manipulated variable preferably occurs gradually, for example, in an S shape or sinusoidally, in order to avoid instabilities. The P-dead time is selected in particular in such a manner that instabilities are avoided.

The absolute value of the I-manipulated variable is particularly preferably increased starting from an I-manipulated value during the cold-running phase upon the presence of a lean combustion after passage of an I-dead time, the increase of the absolute value of the I-manipulated variable occurring incrementally in particular. If the current total manipulated variable of the control unit is not sufficient to cause a change between a state having lean combustion and a state having rich combustion within the I-dead time, a correspondingly large total manipulated variable can be provided by the increase of the absolute value of the I-manipulated variable. Through the incremental increase of the I-manipulated variable, instabilities can be avoided, in that, for example, the level of the following increment and/or the time duration until the next increment are adapted suitably. The I-dead time is particularly selected in such a manner that instabilities are avoided, the I-dead time preferably differing from the P-dead time.

In particular, the absolute value of the I-manipulated variable is decreased immediately after the detection of a rich combustion to a defined minimal I-manipulated value, the decrease of the absolute value of the I-manipulated variable particularly occurring incrementally. A previously performed increase of the I-manipulated variable can be reversed until reaching the defined minimal I-manipulated value. Instabilities can be avoided by the incremental increase of the I-manipulated variable in that, for example, the level of the following increment and/or the time duration until the next increment are adapted suitably.

One embodiment relates to a computer program product having program code means, which are stored on a computer-readable data carrier, in order to perform the above-described method when the program product is executed on a computer, in particular a control unit and/or an engine controller. The control unit and/or the engine controller can be implemented and refined as described above. Reliable and efficient fuel supply is made possible during the cold-running phase of an internal combustion engine with the aid of the computer program product.

One embodiment relates to a computer program having coded instructions for performing the above-described method when the computer program is executed on a computer, in particular a control unit and/or an engine controller. The control unit and/or the engine controller can be implemented and refined as described above. Reliable and efficient fuel supply is made possible during the cold-running phase of an internal combustion engine with the aid of the computer program. The computer program can particularly be stored on the above-described computer program product, for example, a diskette, CD-ROM, DVD, memory, or a computer unit connected to the Internet. The computer program can particularly be designed as a compiled or uncompiled data sequence, which is preferably based on a higher-level, in particular object-based computer language, for example, C, C++, Java, Smalltalk, Pascal, or Turbo Pascal.

One embodiment relates to a signal sequence having computer-readable instructions for performing the above-described method when the signal sequence is processed by a computer, in particular a control unit and/or an engine controller. The control unit and/or the engine controller can be implemented and refined as described above. Reliable and efficient fuel supply is made possible during the cold-running phase of an internal combustion engine with the aid of the signal sequence. The signal sequence can particularly be generated with the aid of the above-described computer program and/or with the aid of the above-described computer program product. The signal sequence can be provided as electrical pulses and/or electromagnetic waves and/or optical pulses in a wireless or wired manner.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
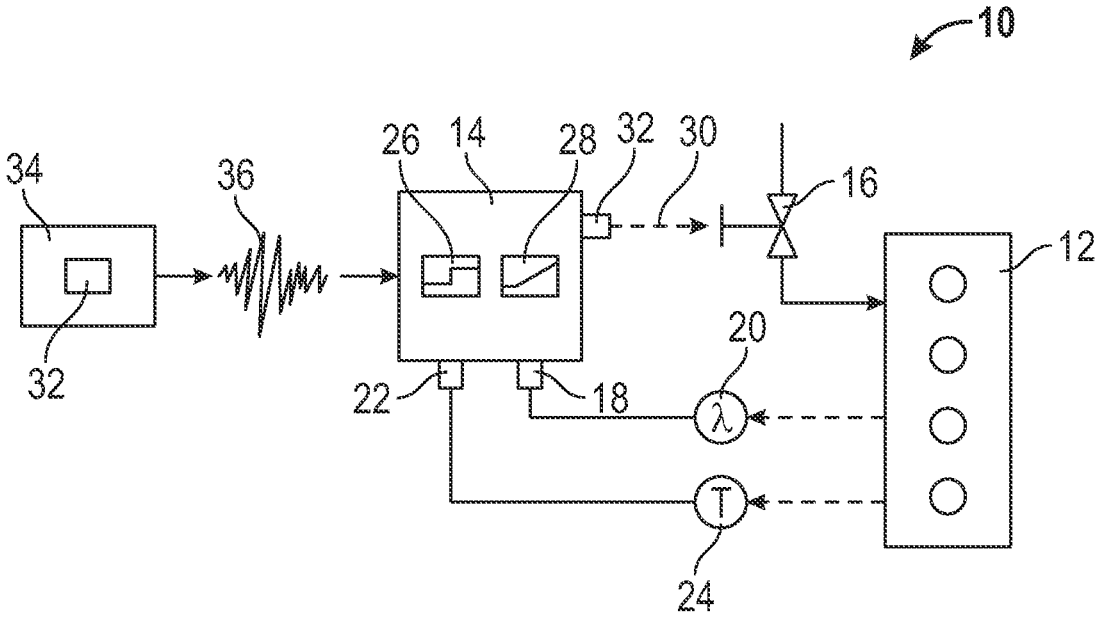
FIG. 1 shows a schematic diagram of an engine controller.

The engine controller 10 for an internal combustion engine 12 shown in FIG. 1 has a control unit 14, which can control a fuel supply 16 of the internal combustion engine 12. The control unit 14 can input, via an input port 18, a combustion signal provided by an exhaust gas sensor 20, which is designed as a discrete-level sensor, about the presence of a rich or lean combustion of a fuel mixture in the internal combustion engine 12. Furthermore, the control unit 14 can input a temperature signal via a temperature port 22, with the aid of which the operating temperature of the internal combustion engine 12 can be estimated. For this purpose, the coolant water temperature of coolant water which cools the internal combustion engine can be provided as the temperature signal in particular with the aid of a temperature measuring sensor 24. The control unit 14 can regulate, from the input information with the aid of a P-element 26 and an I-element 28, a total manipulated variable 30, which can be supplied via an output port 32 to the fuel supply 16.

The method according to which the control unit 14 operates can be stored as a computer program on a computer program product 34 in the form of a data memory and can operate the control unit 32 as the signal sequence 36. The computer program product 32 can also be part of the control unit 14, for example, as the computer unit of the control unit 14.

Figure 2:
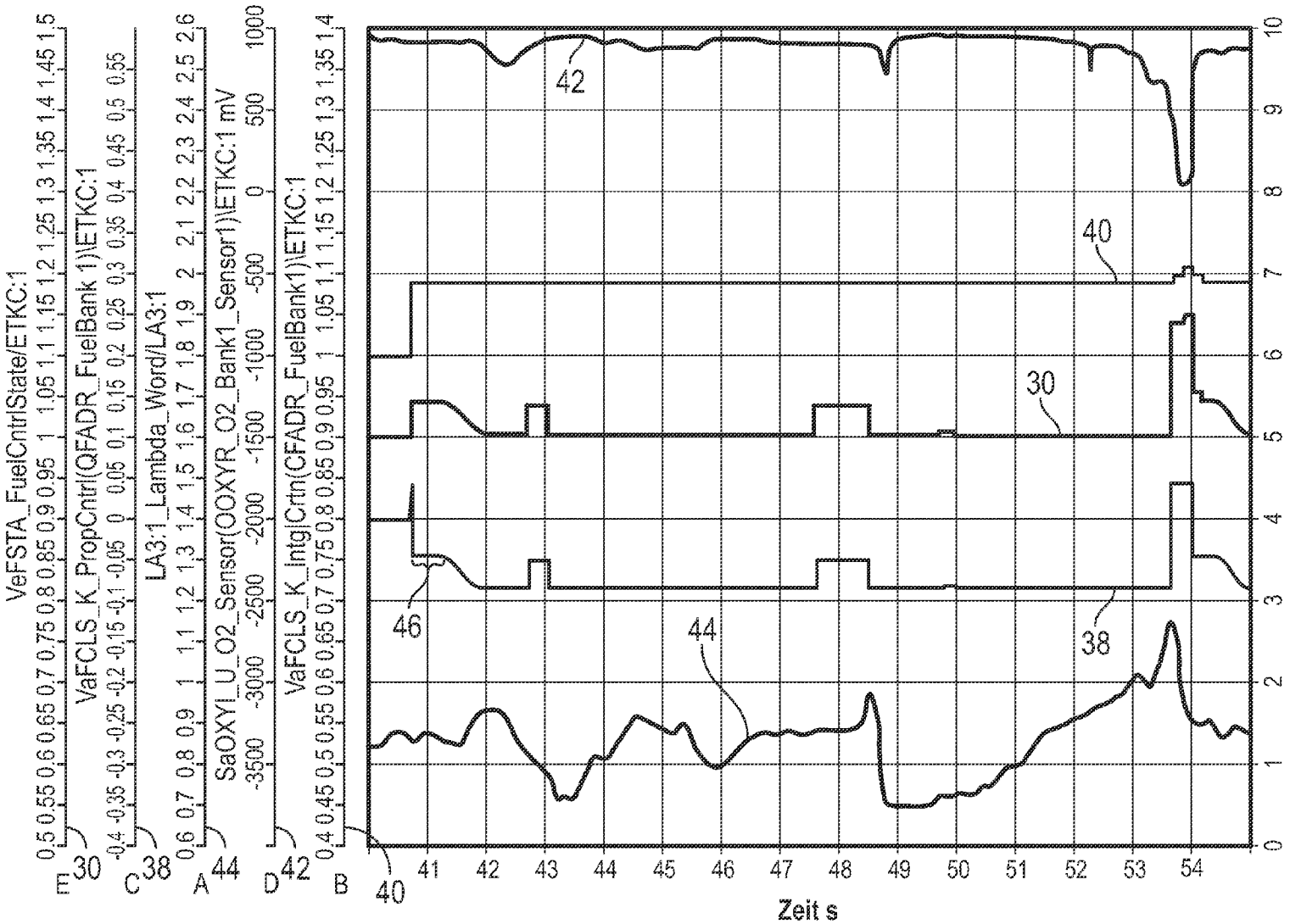
FIG. 2 shows a schematic graph of the time curve of parameters of the engine controller shown in FIG. 1 in a first operating curve.

FIG. 2 shows the time curve of a P-manipulated variable 38 of the P-element 26 and the time curve of an I-manipulated variable 40 of the P-element 26. Furthermore, the total manipulated variable 30 of the control unit 14 is shown, which results from the sum of the P-manipulated variable 38 and the I-manipulated variable 40. The total manipulated variable 30 is designed as a correction factor, so that at the value 1.0 for the total manipulated variable 30, no change of the fuel quantity set by the fuel supply 16 results through the control unit 14. However, it is possible that the fuel quantity set by the fuel supply 16 is changed because of other settings. In addition, a combustion signal 42 is plotted, which is provided by the exhaust gas sensor 20, which is designed as a discrete-level sensor, in the case of an actual lambda value 44.

After a start of the internal combustion engine 12, the I-manipulated variable is set to a value of approximately 1.1, which corresponds to a fuel quantity increased by approximately 10% in comparison to stoichiometric operation ($\lambda$=approximately 1.0). The P-manipulated variable 38 initially jumps to a value of approximately 0.05 and then immediately to a value of approximately −0.05, because the combustion signal 42 detects a rich combustion. In this exemplary embodiment, the P-manipulated variable 38 has a P-mean value of approximately 0.0, to which a reversible P-manipulated absolute value of approximately 0.05 is added upon the presence of a lean combustion or from which it is subtracted upon the presence of a rich combustion. Because no change from a rich combustion to a lean combustion occurs within a P-dead time 46 because of the increased setting of the P-manipulated variable 38, the P-manipulated variable is gradually increased up to a maximum P-final absolute value of approximately 0.08, so that a value of approximately −0.08 results for the P-manipulated variable 38. The P-manipulated variable 38 and the I-manipulated variable 40 thus offset one another to form a total manipulated variable 30 of approximately 1.02, whereby a slight fuel enrichment of approximately 2% results. If a lean combustion is detected by the combustion signal 42 in the event of an actual lambda value 44 of greater than approximately 1.0, the P-manipulated absolute value is reversed, so that the P-manipulated variable 38 jumps from approximately −0.08 to 0 approximately 0.05 and is added to the I-manipulated variable 40 to form a total manipulated variable 30 of approximately 1.15, which corresponds to a very strong fuel enrichment of approximately 15%. A rich combustion is thus achieved again particularly rapidly, so that the P-manipulated variable 38 can jump back to approximately −0.05 and also drop to approximately −0.08 in the further curve. The strong fuel enrichment is reduced again to a slight fuel enrichment through the substantial offsetting of the P-manipulated variable by the I-manipulated variable.

Figure 3:
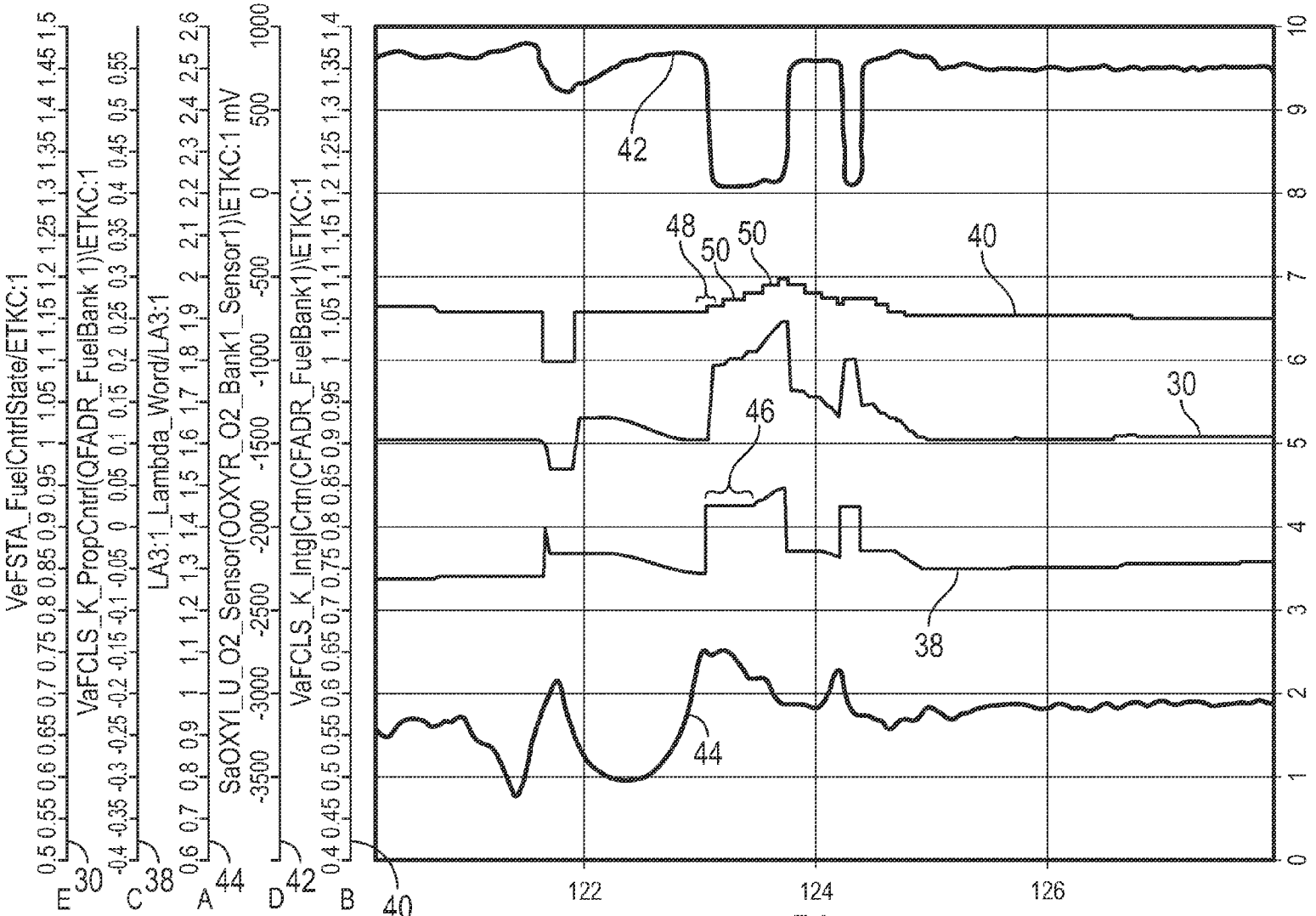
FIG. 3 shows a schematic graph of the time curve of parameters of the engine controller shown in FIG. 1 in a second operating curve.

If, as shown in FIG. 3, a rich combustion is not detected immediately after the detection of a lean combustion, the P-manipulated variable can increased to at most approximately 0.08 after passage of the P-dead time 46. Furthermore, after passage of an I-dead time 48, the I-manipulated variable 40 can be increased incrementally by individual increments 50, in the illustrated exemplary embodiment, the individual increments 50 each being added after passage of the I-dead time 48. However, it is also possible to provide a duration different from the I-dead time 48 between the increments 50, which can be constant or variable for following increments 50. The total manipulated variable 30 is therefore increased again and again until a rich combustion is detected. The I-manipulated variable is then reduced by the increments 50 until the defined minimal I-manipulated variable of 1.1 is reached again.

Figure 4:
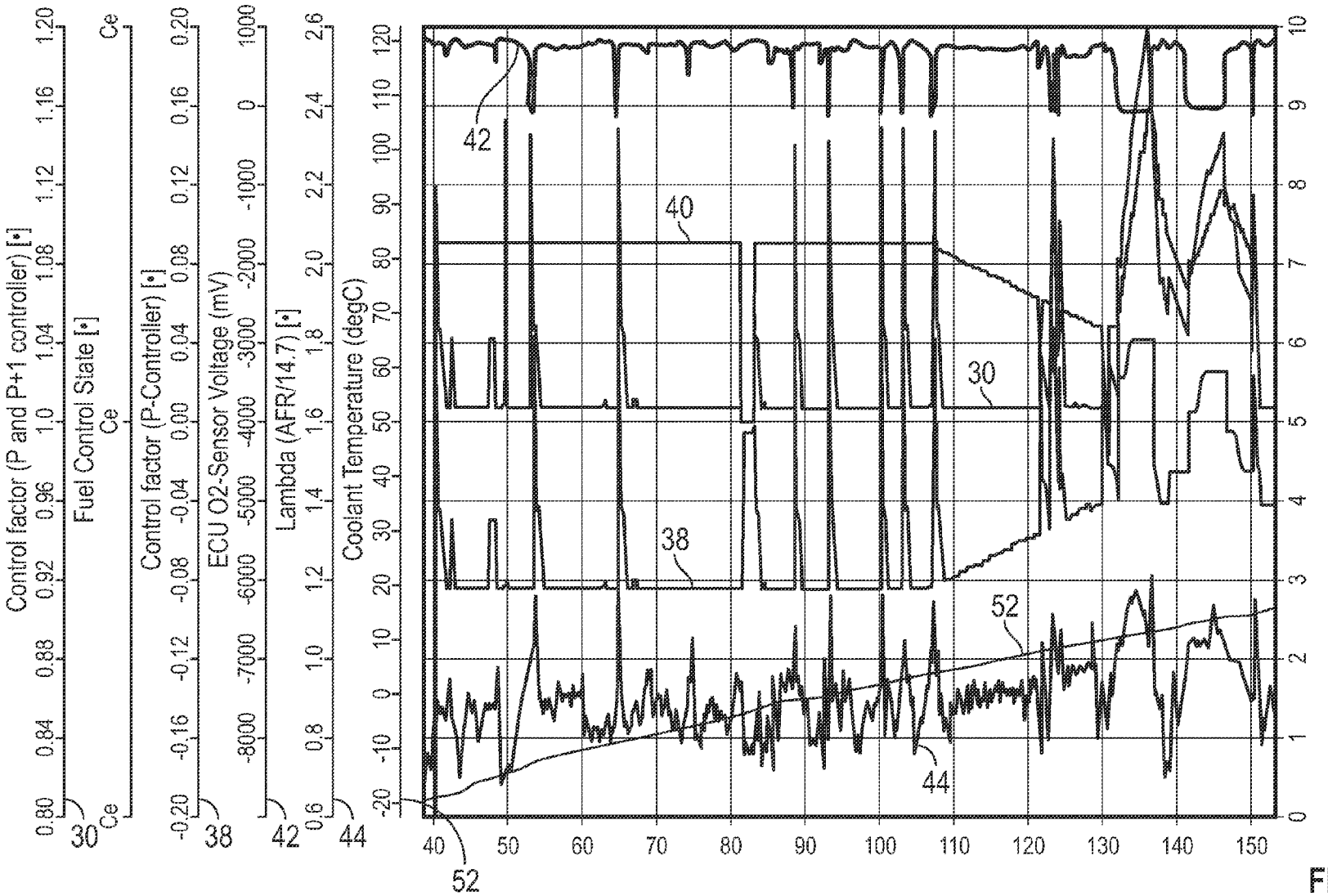
FIG. 4 shows a schematic graph of the time curve of parameters of the engine controller shown in FIG. 1 in a third operating curve.

As shown in FIG. 4, a temperature signal 52, for example, a coolant water temperature, can additionally be input by the control unit 14. A sufficiently high measured temperature signal 52 indicates that the cold-running phase of the internal combustion engine can be ended soon. The absolute values of the P-manipulated variable 38 and the I-manipulated variable 40 can then preferably be reduced in ramped form, so that in the case of a detected lean combustion, a smaller total manipulated variable 30 results. Shortly before the end of the cold-running phase, particularly rich combustion is no longer necessary, so that a lower fuel consumption can be achieved by the smaller total manipulated variable 30 without disadvantageously influencing the combustion provided in the internal combustion engine 12.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A control unit for regulating a fuel supply during a cold-running phase of an internal combustion engine, comprising:

an input port configured to receive a combustion signal about a presence of a combustion state of a fuel mixture in the internal combustion engine;

a P-element configured to provide a P-manipulated variable that sets a fuel reduction upon the presence of the combustion state that is a rich combustion and sets a fuel increase upon the presence of the combustion state that is a lean combustion;

an I-element configured to provide an I-manipulated variable that sets the fuel increase; and an output port configured to control the fuel supply, wherein the P-manipulated variable is substantially offset from the I-manipulated variable during the cold-running phase upon the presence of the rich combustion in a stationary state.

2. The control unit according to claim 1, wherein the P-manipulated variable is produced through a P-manipulated absolute value that is reversible by a P-mean value.

3. The control unit according to claim 2, wherein the P-manipulated absolute value is increased after a reversal from a P-nominal value up to a maximum P-final absolute value.

4. The control unit according to claim 1, wherein an absolute value of the I-manipulated variable is increased from an I-manipulated value with the presence of a lean combustion, and wherein the absolute value of the I-manipulated variable is incrementally increasable.

5. The control unit according to claim 4, wherein the absolute value of the I-manipulated variable is decreased to a defined minimum I-manipulated value with the presence of the rich combustion, and wherein the absolute value of the I-manipulated variable is decreased incrementally.

6. The control unit according to claim 4, further comprising a temperature port that is configured to receive a temperature signal for estimating a temperature of the internal combustion engine, and wherein the absolute value of the I-manipulated variable is decreased as a function of the temperature signal.

7. A method for fuel supply regulation during a cold-running phase of an internal combustion engine with aid of a control unit, comprising:

providing a P-manipulated variable;

setting a fuel reduction with a presence of a rich combustion;

setting a fuel increase upon the presence of a lean combustion;

providing an I-manipulated variable that sets the fuel increase;

wherein the P-manipulated variable is substantially offset from the I-manipulated variable during the cold-running phase upon the presence of the rich combustion in a stationary state.

8. The method according to claim 7, further comprising adding the P-manipulated variable and the I-manipulated variable to form a total manipulated variable with the presence of a lean combustion, wherein a maximum absolute value of the total manipulated variable during the cold-running phase is greater than the maximum absolute value of the total manipulated variable after passage of the cold-running phase.

9. The method according to claim 7, further comprising increasing an absolute value of the P-manipulated variable during the cold-running phase with the presence of a lean combustion after passage of a P-dead time.

10. The method according to claim 9, further comprising increasing the absolute value of the I-manipulated variable starting from an I-manipulated value during the cold-running phase with the presence of a lean combustion after passage of an I-dead time, wherein the increasing of the absolute value of the I-manipulated variable is an incremental increase.

11. The method according to claim 10, further comprising decreasing the absolute value of the I-manipulated variable to a defined minimal I-manipulated value after the detecting of the rich combustion, wherein the decreasing of the absolute value of the I-manipulated variable is an incremental decrease.

12. A computer readable medium embodying a computer program product, said computer program product comprising:

a regulation program for fuel supply regulation during a cold-running phase of an internal combustion engine with aid of a control unit, the regulation program configured to:

provide a P-manipulated variable;

set a fuel reduction with a presence of a rich combustion;

set a fuel increase with the presence of a lean combustion;

provide an I-manipulated variable that sets the fuel increase;

wherein the P-manipulated variable is substantially offset from the I-manipulated variable during the cold-running phase upon the presence of the rich combustion in a stationary state.

13. The computer readable medium embodying the computer program product according to claim 12, the regulation program further configured to add the P-manipulated variable and the I-manipulated variable to form a total manipulated variable with the presence of a lean combustion, wherein a maximum absolute value of the total manipulated variable during the cold-running phase is greater than the maximum absolute value of the total manipulated variable after passage of the cold-running phase.

14. The computer readable medium embodying the computer program product according to claim 12, the regulation program further configured to increase an absolute value of the P-manipulated variable during the cold-running phase with the presence of a lean combustion after passage of a P-dead time.

15. The computer readable medium embodying the computer program product according to claim 14, the regulation program further configured to increase the absolute value of the I-manipulated variable starting from an I-manipulated value during the cold-running phase with the presence of a lean combustion after passage of an I-dead time, wherein the increasing of the absolute value of the I-manipulated variable is an incremental increase.

16. The computer readable medium embodying the computer program product according to claim 15, the regulation program further configured to decrease the absolute value of the I-manipulated variable to a defined minimal I-manipulated value after the detecting of the rich combustion, wherein the decreasing of the absolute value of the I-manipulated variable is an incremental decrease.

* * * * *